US005236266A

United States Patent [19]

Mitsuishi et al.

[11] Patent Number: 5,236,266

[45] Date of Patent: Aug. 17, 1993

[54] STACKED PRINT WIRE DRIVING DEVICE FOR WIRE TYPE DOT PRINTER

[75] Inventors: Akio Mitsuishi; Yasuhiko Nakazawa; Takumi Sato, all of Suwa, Japan

[73] Assignee: Seiko Epson Corporation, Tokyo, Japan

[21] Appl. No.: 729,301

[22] Filed: Jul. 12, 1991

Related U.S. Application Data

[60] Continuation of Ser. No. 421,050, Oct. 13, 1989, Pat. No. 5,048,985, which is a continuation of Ser. No. 235,864, Aug. 24, 1988, Pat. No. 4,915,524, which is a division of Ser. No. 823,167, Jan. 27, 1986, Pat. No. 4,767,227.

[30] Foreign Application Priority Data

| | | | |
|---|---|---|---|
| Jan. 25, 1985 | [JP] | Japan | 60-8970 |
| Jan. 25, 1985 | [JP] | Japan | 60-8971 |
| Jan. 25, 1985 | [JP] | Japan | 60-11854 |
| Jan. 25, 1985 | [JP] | Japan | 60-11855 |
| Jan. 25, 1985 | [JP] | Japan | 60-11856 |
| Jan. 25, 1985 | [JP] | Japan | 60-11857 |
| Jan. 25, 1985 | [JP] | Japan | 60-11858 |
| Feb. 20, 1985 | [JP] | Japan | 60-23356 |
| Feb. 20, 1985 | [JP] | Japan | 60-23357 |
| Feb. 20, 1985 | [JP] | Japan | 60-31928 |

[51] Int. Cl.[5] ..... B41J 2/235

[52] U.S. Cl. ..... 400/124; 101/93.05

[58] Field of Search ..... 400/124, 124 GT; 101/93.05

[56] References Cited

U.S. PATENT DOCUMENTS

| | | | |
|---|---|---|---|
| 4,009,772 | 3/1977 | Glaser et al. | 400/124 |
| 4,165,940 | 8/1979 | Cacciola | 400/124 |
| 4,214,836 | 7/1980 | Wang | 400/124 |
| 4,230,412 | 10/1980 | Hebert | 400/124 |
| 4,240,756 | 12/1980 | Ku et al. | 400/124 |
| 4,453,840 | 6/1984 | Hodne | 400/124 |
| 4,478,528 | 10/1984 | Hebert | 400/124 |
| 4,611,393 | 9/1986 | Norigoe | 400/124 |
| 4,626,115 | 12/1986 | Norigoe | 400/124 |
| 4,641,981 | 2/1987 | Blomquist et al. | 400/124 |

FOREIGN PATENT DOCUMENTS

| | | | |
|---|---|---|---|
| 2947398 | 5/1981 | Fed. Rep. of Germany | 400/124 |
| 20368 | 2/1982 | Japan | 400/124 |
| 173179 | 10/1982 | Japan | 400/124 |
| 55255 | 4/1983 | Japan | 400/124 |
| 148670 | 8/1984 | Japan | 400/124 |
| 229357 | 12/1984 | Japan | 400/124 |
| 6475 | 1/1985 | Japan | 400/124 |
| 132770 | 7/1985 | Japan | 400/124 |
| 187563 | 9/1985 | Japan | 400/124 |

*Primary Examiner*—David A. Wiecking
*Attorney, Agent, or Firm*—Blum Kaplan

[57] ABSTRACT

A print wire driving device for a wire dot printer includes a plate like member having slots therein. The slots are arranged opposite the cores of a magnetic core block. The cores are arranged in a circle and project from the core block. The slots extend radially from the center of the plate like member. A magnetic driving member is received in each slot so that it pivots therein when acted upon by the magnetic field of a respective magnetic core. A print wire is coupled to each magnetic driving member. Each print wire is guided by a wire guide having a wire nose which receives at its end a wire guide member from which the ends of the print wires extend to print. The wire guide includes structure for properly aligning two stacks of magnetic actuators.

2 Claims, 11 Drawing Sheets

STACKED PRINT WIRE DRIVING DEVICE FOR WIRE TYPE DOT PRINTER

This is a continuation of application Ser. No. 07/421,050, filed on Oct. 13, 1989, now U.S. Pat. No. 5,048,985to which itself is a continuation of application Ser. No. 07/235,864, filed on Aug. 24, 1988, now U.S. Pat. No. 4,915,524 which itself is a division of application Ser. No. 06/823,167, filed on Jan. 27, 1986, now U.S. Pat. No. 4,767,227 issued on Aug. 30, 1988.

BACKGROUND OF THE INVENTION

The present invention is generally directed to a print wire driving device for wire type dot or dot matrix printers.

In wire type dot printers, it is necessary for a number of print wires, and apparatus for driving these wires, to be assembled within a limited space. Japanese Patent Publication No. 58-35475 is typical of a configuration in which a plurality of rockable driving plates are radially arranged and a print wire is secured to the end of each of the driving plates. The driving plates form part of a magnetic circuit.

This conventional configuration requires that each driving plate be of at least some minimum thickness near its end so that a minimum cross-sectional area can be acted upon by magnetic flux of a given density in order to move the plates and thereby drive the wires. Such limitation in the reduction of the size of the driving plate results in a large head structure. Further, the driving plates have a great deal of inertia and therefore deteriorated response characteristics.

In these conventional configurations, the driving head is composed of a large number of small parts which must be positioned and secured to one another with machine screws. Production of such driving heads is labor intensive and not efficient. Further, a high degree of precision cannot generally be obtained. The driving plates are generally pivotally secured at their outer ends by a driving plate cap which pinches the plates from above. As a result of the outer ends serving as a support point, the driving plates move excessively in a direction perpendicular to the required axial rocking motion during operation. This adversely affects the printing action by increasing frictional forces or causing bending of the print wires. Further, in this type of configuration it is very difficult to assemble the driving plates, which are arranged in a plane, so that they are pivotally supported by the cap plate without displacement from their proper positions.

In order to increase the number of dots which form a character to improve the printing quality, a number of print heads are often stacked one upon another in the axial direction of the head assembly because only a limited number of print wire driving members can be assembled in a limited planar area. However, it is difficult to accurately maintain the desired positional relationship between the print wires from the axially stacked driving assemblies to the nose section of the printing head.

In the driving mechanism, electromagnets of the smallest possible size are arranged in a circle to attract and drive print wire driving magnetic segments, positioned in facing relationship to the electromagnets with a given required force. A magnetic pole surface of each core is generally positioned inside a coil in order to maximize the force of attraction. It is generally very difficult to machine these magnetic pole surfaces so that they are all positioned in the same plane. As a result, variations in the strength of attraction of the print wire driving segments often occur thereby resulting in deteriorated printing quality due to lack of uniform darkness in the printed character.

In conventional wire driving devices, current may be provided to the coils of the electromagnets by means of a flexible printed wiring cable. A conductive pattern formed on an end of the substrate corresponds to electrical connection pins electrically connected to the coils of the electromagnets. Solder is applied to electrically connect the pattern to the pins. However, due to the presence of a large number of pins, the conductive pattern is generally complex and each conductive path of the pattern is very narrow. This lowers the reliability of the soldering and decreases the current carrying capacity of the conductive pattern.

Generally the pins, which are soldered to the conductive pattern, are those of a coil bobbin. This requires that two metal pins be affixed to the bobbin, each serving as a terminal for the electromagnet coil. Each metal pin is press fitted into the substrate of the bobbin and the end of the winding is coiled around the pin which is then soldered to an island of the circuit pattern. This arrangement is labor intensive in that the metal pins must be prepared and then affixed to the bobbin. Further, after soldering to the conductors of the printed wiring cable, the ends of the pins projecting beyond the substrate thereof must be removed. In addition, a relatively long period of time is required to perform soldering due to the large heat capacity of the metal pins.

In conventional configurations, a supporting member for holding the print wire driving mechanism and for leading the print wires out to the nose of the print head is generally made of a synthetic resin due to the complexity of its shape. The rigidity of such a conventional supporting member is poor. Thus, precision of mounting is difficult to achieve even if a print wire guide member, attached to the nose or the print head, is mounted by the supporting member to a carriage. Heat which is generated inside the head assembly cannot effectively escape toward the carriage because of the low thermal conductivity of the synthetic resin.

In conventional configurations, the print wire guide member, attached at the nose of the print head, contains a number of guide holes bored in its surface which serve to guide a corresponding number of print wires and to align the wires in accordance with the size of a font to be printed. Each print wire is driven in the longitudinal direction of the guide holes by means of the electromagnetic driving mechanism. This causes a great deal of wear, enlarging the guide holes, thus reducing printing quality to an extent dependent upon the nature of the fit between a print wire and its corresponding guide hole.

Accordingly, there is a need for a print wire driving device having a configuration which results in improved positioning and maintenance of the position of the print wire driving segments, has an improved structure for connecting the electromagnetic coils to the flexible printed wiring cable, has a bobbin structure which is less costly and requires less labor to produce, and has supporting members and print wire guides which have close tolerances and are not subject to wear.

SUMMARY OF THE INVENTION

The invention is generally directed to print wire driving apparatus used in wire type dot or dot matrix printers. A print wire driving apparatus includes a plate like member having slots arranged so as to be perpendicular to a longitudinal axis of the apparatus. The member is formed of a magnetic material. A magnetic driving lever is disposed in each slot. A print wire is attached to each magnetic driving lever. Support means pivotally support the magnetic driving levers in the slots. A magnetic circuit means provide a magnetic field to the magnetic driving levers to cause the levers to pivot and to thereby move the print wires. The plate like member is part of the magnetic circuit. Electromagnets selectively and temporarily energize portions of the magnetic circuit to cause selected ones of the print wires to print.

In accordance with the invention, the print wire driving apparatus also comprises a magnetic core block having a first substantially planar portion. The magnetic core block has a plurality of magnetic cores extending from the planar portion in a direction perpendicular thereto. The core block has a annular rim which also extends in a direction perpendicular to the first planar portion. The annular rim and the magnetic cores extend from the planar portion by substantially equal distances. The magnetic core block and the plate like member define a portion of the magnetic circuit.

In accordance with another aspect of the invention, the magnetic driving levers have a laminated construction with magnetic driving segments attached to either side of each magnetic driving lever.

The present invention also provides a coil bobbin having a first flange, a region for winding a coil about the bobbin and at least two pins extending from the first flange. The pins are integrally formed with the bobbin of a synthetic resin.

The present invention is also directed to a flexible printing wiring cable connector for providing electrical connection to an object having electrical connection pins extending therefrom. The connector comprises a substrate with a plurality of branches. The substrate is configured so that portions of the branches may be stacked upon one another. The portions of the substrate have pin insertion paths at positions corresponding to the pins for receiving the pins from the object. Conductors on the substrate extend to selected ones of the pin insertion paths on each portion. A connecting section of the substrate may be disposed intermediate two of the branches. The connecting section may be foldable so that the two branches can be stacked one over the other.

The present invention is also directed to a wire dot printer having a wire guide means with a portion for receiving, at an end thereof, a substantially planar member extending perpendicular to a longitudinal axis of the wire guide means. A plurality of wires are received in the wire guide means. A drive means is operatively associated with the wires for driving the wires in a direction parallel to the longitudinal axis. A wire guide member is received in the portion of the wire guide. The wire guide member projects beyond the wire guide in a direction perpendicular to the longitudinal axis. A cover for receiving an end of the wire guide means having the wire guide member is provided. The cover has a surface with an opening therein corresponding in shape to that of the end of the wire guide means with the wire guide member received therein. The cover is preferably made of a metallic material.

According to the present invention, a print wire guide device wherein print wires are driven in a longitudinal direction of the wire guide device is also provided. The print wire guide device has a member having a side wall for defining a passageway for receiving the wires. The passageway terminates in an end having an inner row of through-holes and an outer row of through-holes. The inner row of through-holes and the outer row of through-holes are arranged along a curved path wherein inner through-holes alternate with outer through-holes so that the outer through-holes are on one side of the path and the inner through-holes are on the other side of the path. The side wall has concave wire guide grooves formed in portions of the side wall corresponding to respective outer through-holes. The print wire guide device is operatively associated with a wire driving means having a first section for driving a first set of the wires and a second section for driving a second set of the wires. The first set of wires is received in the inner through-holes while the second set of wires is received in the outer thorough-holes.

The present invention also provides a wire guide member for use in a nose of a wire type dot printer. The member comprises a first plate formed of a synthetic resin, a second plate formed of a wear resistant material and a third plate formed of a synthetic resin. The second plate is sandwiched between the first plate and the third plate. The second plate is formed of a wear resistant material which may be ceramic, glass or ruby.

Also in accordance with the present invention, a first plate like member, such as the wire guide member, is received in a second member having grooves for receiving the first member. A plurality of projections extend from the first member so as to be disposed in at least one of the grooves, between the first member and the second member. The projections are deformable so as to provide a wedge action between the first member and the second member when the first member is inserted into the grooves. Thus, motion of the first member with respect to the second member in a direction opposite to that of insertion is inhibited. The projections are preferably of conical cross-section.

Accordingly, it is an object of the invention to provide a print wire driving device for a wire dot printer which is small in size and provides precise printing.

A second object of the present invention is to provide a wire dot printer having print wire driving members wherein the ends of the members are positioned so as to be removed from the path of magnetic flux so that the ends may be as thin as possible, thus facilitating miniaturization and reducing inertia.

It is a third object of the present invention to provide a wire dot printer in which distance between the magnetic pole surfaces of each magnetic core and the corresponding print wire driving segments can be maintained to a high degree of precision so that characters of uniform print quality are produced.

It is a fourth object of the present invention to provide a wire dot printer of simple construction which can be assembled to a high degree of precision without using fixing members such as machine screws.

It is a fifth object of the present invention to provide a wire dot printer having a construction which assures accurate movement of the print wire driving members and permits easy assembly thereof.

It is a sixth object of the present invention to provide a print wire guide device which accurately leads each print wire of a print head toward the end of the nose thereof and which facilitates assembly of the print wires in the nose.

It is a seventh object of the present invention to provide a flexible printed wiring cable connector having soldering portions which are arranged dispersively to permit accurate and reliable soldering thereto.

It is an eighth object of the present invention to provide a small coil bobbin which can be assembled to a printed circuit substrate in a minimum amount of time while using a minimal number of parts.

It is a ninth object of the present invention to provide a wire dot printer having a head assembly which can be manufactured to a high degree of precision by utilizing the exceptionally good formability of synthetic resin material and the high rigidity and good thermal conductivity of a metallic material so that internal heat can be effectively conveyed outward from the mechanism.

It is a tenth object of the present invention to provide a wire dot printer which is durable, reliable and in which print wires are smoothly guided.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

The present invention is directed to a print wire driving apparatus for a wire type dot or dot matrix printer and is described with specific reference to a wire dot printer in which the wire dots are arranged for printing in two parallel rows, although it applies as well to wire dot printers in which the print wires are arranged in a single vertical row or any other suitable pattern. The present invention also is described with reference to a print wire driving apparatus having two "stacked" sections of driving components, each section of components being for driving several wires, but the invention also applies to printers having a single section of driving components or additional stacked layers of components.

Figure 1:
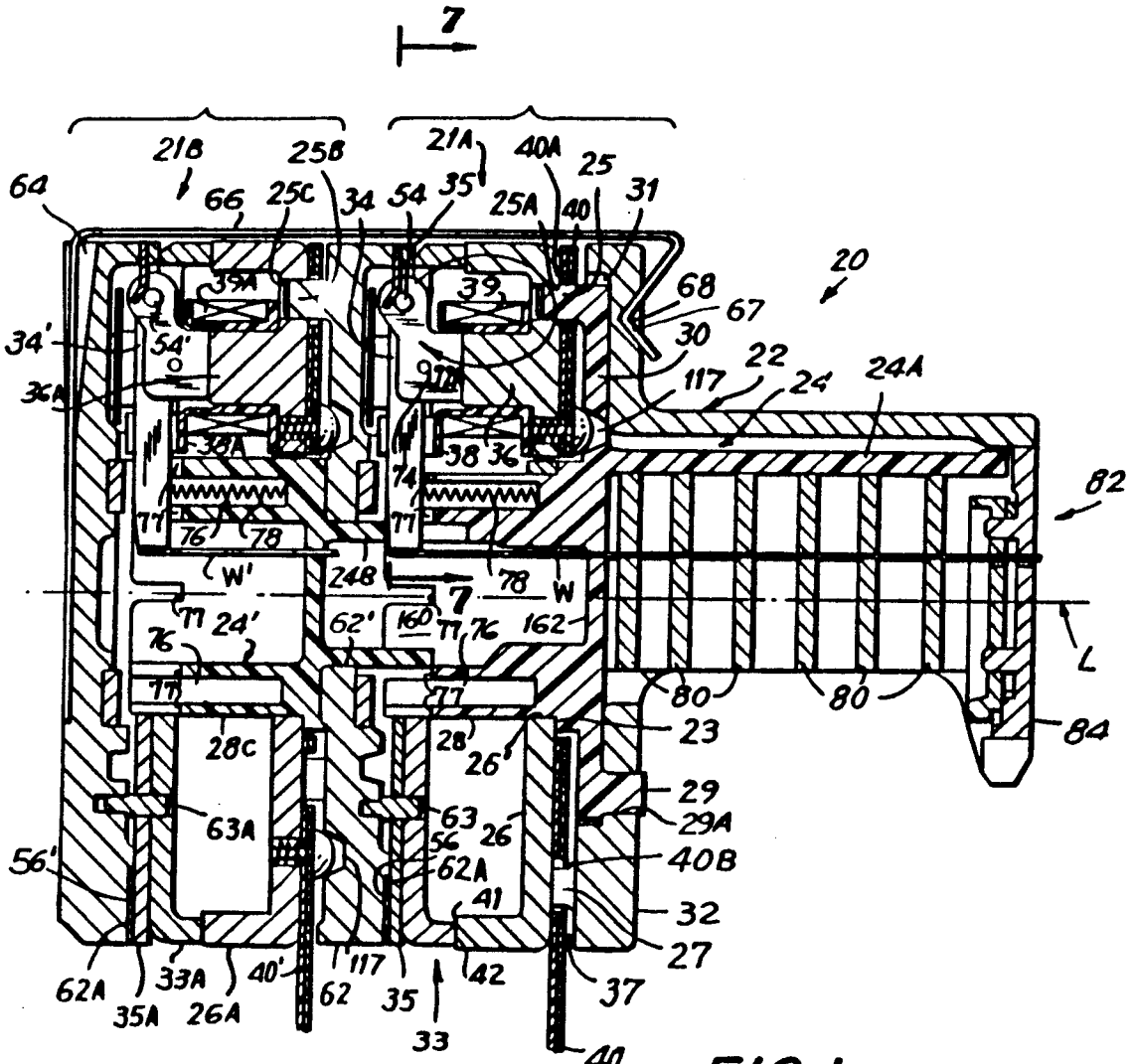
FIG. 1 is an enlarged cross-sectional view of a print wire driving device constructed in accordance with a preferred embodiment of the invention.
Figure 2:
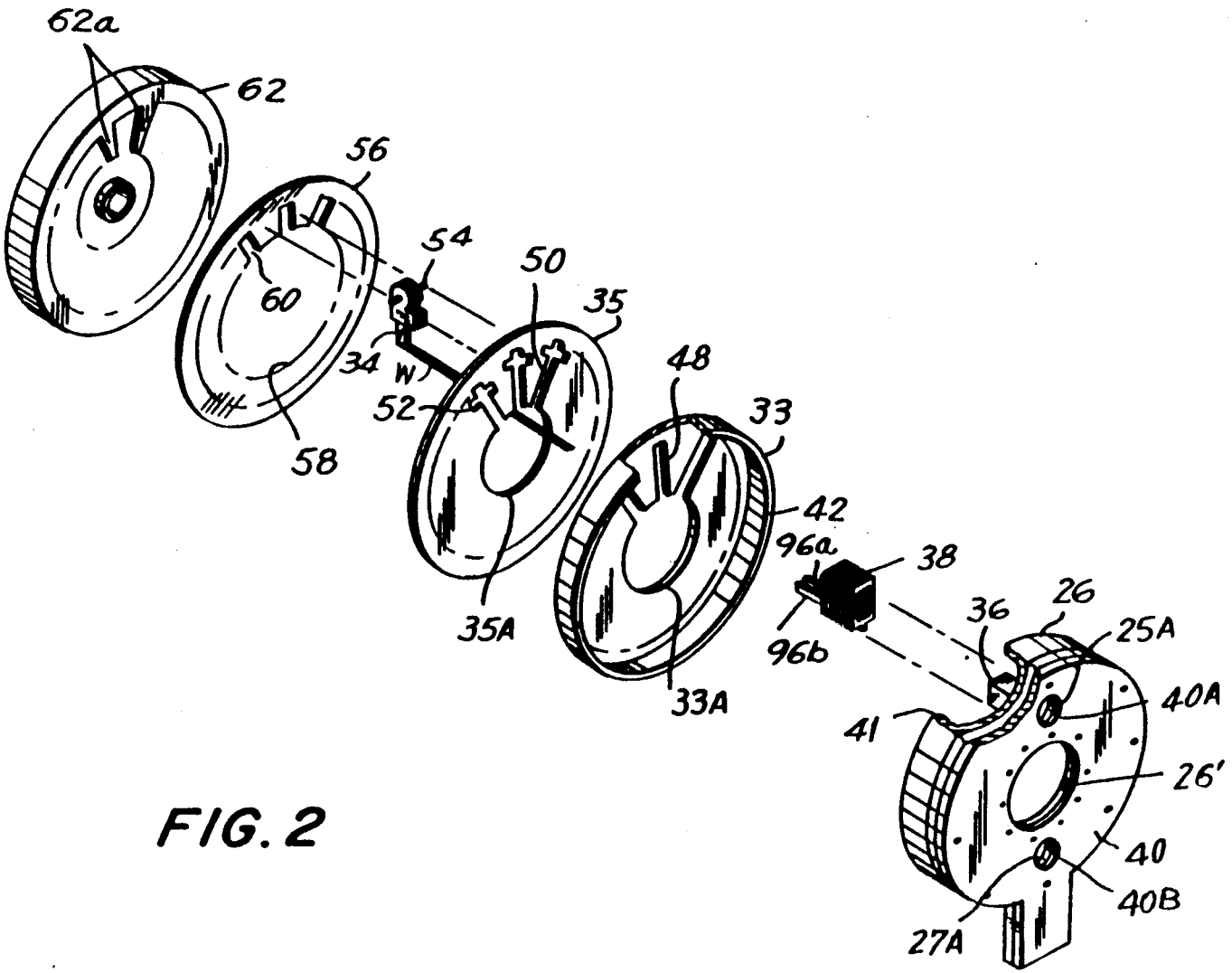
FIG. 2 is an exploded perspective view of the principal driving components of the device of FIG. 1.

Referring to FIG. 1 and FIG. 2, a print wire driving apparatus shown generally at 20 includes two sections 21A and 21B of wire driving components which operate in an essentially identical manner, and are described with reference to section 21A, the components of section 21B being specifically described only when departing in structure or function from corresponding components of section 21A.

In apparatus 20, a cover or support member 22 supports therein a guide member 24 (referred to hereinafter as wire guide 24) (both described below with reference to FIG. 14). Wire guide 24 has an alignment pin 25 which is received in an opening 25A in a shallow cylindrical core block 26 formed of a magnetic material. Core block 26 is also positioned by an inner cylindrical section 28 formed integrally as part of wire guide 24 and extending into a central circular opening 26' in core block 26. Opening 26' is sized so that core block 26 is positioned with respect to the length of cylindrical section 28 so that its outer surface rests on an annular shoulder 23 of wire guide 24. A pin 27, integrally formed as a part of support member 22, extends into an opening 27A (FIG. 2) in core block 26. A pin 29, integrally formed as a part of wire guide 24, extends from a flange 30 in wire guide 24 into an opening 29A in support member 22. Pin 25 also extends from flange 30 but in the opposite longitudinal direction. Cylindrical section 28 is eccentrically positioned with respect to flange 30. Flange 30 is received in a shallow cylindrical recess 31 in a flange 32 of support member 22. Thus, alignment is maintained between A wire nose 24A of wire guide 24 extends from flange 30, and guides print wires W and W' as more fully described below.

Core block 26 forms part of a magnetic circuit with a cylindrically shaped yoke shown generally at 33 having a central circular opening 33A, so that yoke 33 may be received on cylindrical section 28. Integral cores 36 of yoke 33 serve to attract magnetic driving levers 34 pivotally supported in a side yoke 35. In the illustrated embodiment, core block 26 is configured with twelve cores 36, each core 36 being of rectangular cross-section and surrounded by a correspondingly shaped bobbin 38 having a coil 39 wound thereon. Cores 36 are arranged in a circle around a central longitudinal axis L of driving apparatus 20. Each bobbin 38 is mechanically secured, and each respective coil 39 electrically connected, to a printed cicuit connector 40 as more fully described below. Printed circuit connector 40 is of a thickness which may be easily accommodated in a ring shaped region 37 between the outer planar surface of core block 26 and the opposed planar surfaces of wire guide 24 and support member 22, the thickness of region 37 being defined by the height of pin 27. Printed circuit connector 40 is provided with apertures 40A and 40B through which pins 25 and 27, respectively, extend.

An annularly shaped planar end surface 41 of the cylindrical section of core block 26 abuts a corresponding annularly shaped planar end surface 42 of yoke 33. Yoke 33 is positioned by inner cylindrical section 28 of wire guide 24.

Twelve radial slots 48 are formed in the planar surface of yoke 33. These slots have a dimension sufficient for receiving driving levers 34 so that levers 34 are rockable therein.

Side yoke 35 is a disk formed from a magnetic material. Side yoke 35 has a central circular opening 35A which serves to position side yoke 35 on cylindrical section 28 of wire guide 24 so as to be in contact with the outer surface of yoke 33.

Radial slots 50, corresponding to slots 48 are provided in side yoke 35. A transverse groove 52 extends perpendicularly to each radial slot 50. Grooves 52 are sized and shaped so as to each rotationally receive a shaft 54 of one magnetic driving lever 34. A spring plate 56 (FIGS. 2 and 6), having a relatively large central opening 58 and twelve radial grooves 60 extending therefrom, serves to secure driving levers 34 in place in driving apparatus 20, as discussed more specifically below.

A cap plate 62 covers spring plate 56 and driving levers 34, thus completing portion 21A of apparatus 20 suitable for driving twelve driving wires W with twelve radially arranged magnetic driving levers 34. Cap plate 62 has a series of twelve radially extending ribs 62A projecting from its internal surface so that each rib contacts spring plate 56 at a position between radial grooves 60. Cap plate 62, side yoke 35 and yoke 33 are maintained in alignment by a pin 63 extending from a socket in cap plate 62 through corresponding holes in these components.

As shown in FIG. 1, an additional section of components, 21B similar to those shown in FIG. 2, may be assembled to the back (to the left as viewed in FIG. 1) of the components described above, thus providing an additional twelve driving levers 34' for driving an additional twelve print wires W'. A core block 26A is positioned by a pin 25B projecting from cap plate 62 into an opening 25C in core block 26A. A central wire guide 24' has a small diameter central cylindrical portion 24B received in a circular central opening 62' of cap plate 62. A yoke 33A, and a side yoke 35A are supported and aligned by a large diameter cylindrical portion 28C of wire guide 24'. Spring plate 56' serves to capture twelve driving levers 34' mounted on shafts 54 in grooves and slots of side yoke 35' corresponding to grooves 52 and slots 50. Each driving lever 34' supports a print wire W'. The end component of the print wire driving apparatus 20 is cap plate 62A having a suitable recess 64 on its external surface for receiving a retaining member 66, in the form of a plate, which has a bent part 67 received in a recess 68 formed in flange 32 of support member 22 and which serves to secure cap plate 62A in place and hold the stack of components of driving apparatus 20 securely together. A pin 63A extending from a socket in cap plate 62A serves to align cap plate 62A, side yoke 35A and yoke 33A by extending into holes therein.

Core block 26A, as is the case for core block 26, has twelve cores 36A, each having thereon a bobbin 38A around which a coil 39A is wound. The twelve bobbins 38A are mechanically secured and their twelve respective coils 39A are electrically connected to a printed circuit connector 40'.

Figure 3:
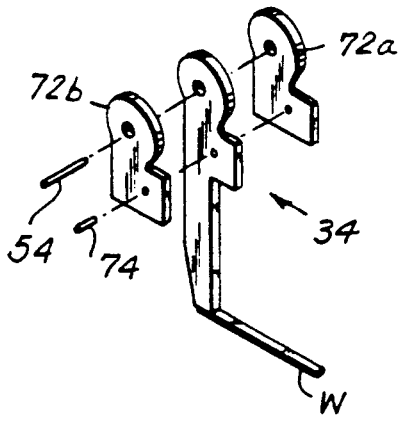
FIG. 3 is an exploded, enlarged, perspective view of a driving lever of the device of FIGS. 1 and 2.

Referring also to FIG. 3, each driving lever 34 has secured thereto a print wire W. Driving lever 34 is made as thin as possible to have low inertia. Two ferromagnetic segments 72*a* and 72*b* are attached to lever 34 by welding to a common pin 74 which passes through driving lever 34. Ferromagnetic segments 72*a* and 72*b* provide a sufficient magnetic working area so that a sufficient force may be generated to cause levers 34 to rock about shafts 54. However, the use of a laminated structure results in remarkably small eddy current loss. Eddy current losses may be further reduced if an insulating coating is applied to the surfaces of magnetic segments 72*a* and 72*b* and said segments are then secured to lever 34 with a suitable adhesive.

Cylindrical section 28 of wire guides 24 has twelve longitudinally extending holes 76, each for receiving a spring 78. Holes 76 are equiangularly spaced about longitudinal axis L so that each spring 78 is positioned for urging one driving lever 34 to pivot clockwise (as shown in FIG. 1) about its respective shaft 54 so that wires W and W' are biased to a non-printing position.

Wire guide 24 has a series of six wire guide plates 80 each with twenty-four openings through which wires W and W' extend. The openings in each of wire guide plates 80 are aligned with the openings in the others wire guide plates and in wire guides 24 and 24' so that wires W and W' may move freely from left to right as viewed in FIG. 1 from a non-printing position to a printing position. As noted above, springs 78, acting on levers 34 return the wires to the non-printing position (right to left in FIG. 1).

The wires W and W' all extend through openings in a wire guide member 82, more fully described below with reference to FIGS. 14–16. An ink ribbon (not shown) is disposed so that it is parallel to surface 84 of guide member 82. When the wires move from a non-printing to a printing position, they protrude slightly beyond surface 84, impact the ribbon and cause printing on paper (not shown) immediately behind and parallel to the ribbon.

Figure 4A:
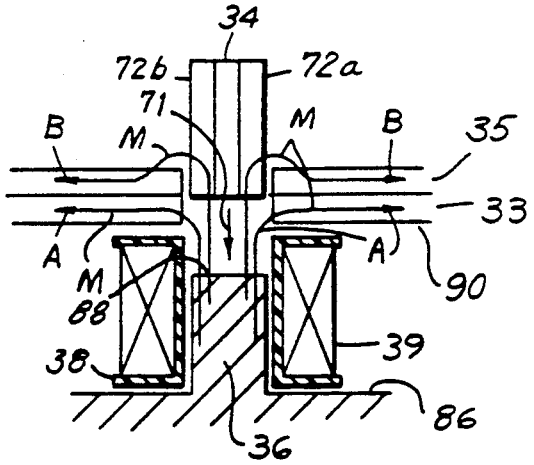
FIGS. 4*a* and 4*b* are schematic views illustrating the driving motion which occurs during printing.

Referring to FIG. 4*a*, each magnetic core 36 extends from planar portion 86 of core block 26 by a sufficient distance so that its free surface 88 is flush with annular surface 41 (FIG. 1) of core block 26. Thus, core block 26 is integrally formed with cores 36. Free surfaces 88 and annular surface 41 are all simultaneously precision machined and polished so as to be located in a single plane. This provides for precision in the location of free surfaces 88 of cores 36 with respect to one another and with respect to annular surface 41 which is not obtainable if cores 36 are made of separate members which are assembled to a common core block, as in the prior art. Annular surface 42 of yoke 33 is also precision machined and polished to lie in the plane of surfaces 88 and 41 and to precisely define the thickness X (FIG. 6) of yoke 33. In this way the distance Y (FIG. 6) between the attracted surfaces of ferromagnetic segments 72*a* and 72*b* and surfaces 88 of cores 36 is set to an optimum value. Further, since the distance Y is the same for each core, the printed characters are of uniform darkness throughout.

Figure 4B:
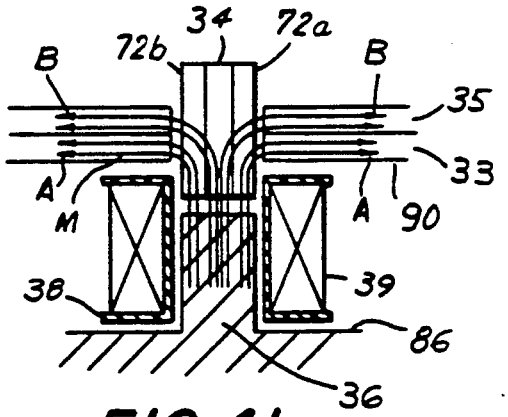

As shown in FIG. 4*a*, there is a gap between free surface 88 of each core 36 and interior surface 90 of yoke 33. A magnetic circuit is formed through core block 26, yoke 33 and side yoke 35 as represented by magnetic lines of flux M, when current is sent through coil 39 of bobbin 38. The magnetic flux from core 36 is divided into two paths A and B. The magnetic lines of flux M extending along path A enter the surfaces which define radial slots 48 in yoke 33 and return through the cylindrical portions of yoke 33 and core block 26 to planar portions 86 of core block 26 and finally again to core 36. Magnetic flux also passes through side yoke 35, entering by way of the surfaces defining radial slots 50, along magnetic path B. In this path, the magnetic lines of flux pass through ferromagnetic segments 72*a* and 72*b* of lever 34. Segments 72*a* and 72*b* are first attracted into the path of the magnetic flux line M along path B. Then, upon pivoting of lever 34 toward surface 88, segments 72*a* and 72*b* are attracted directly by the magnetic flux of path A. Thus, lever 34 pivots about shaft 54 and lever 34 moves in the direction of arrow 71 (FIG. 4*a*) from the position illustrated in FIG. 4*a* to the position illustrated in FIG. 4*b*. When current no longer flows in coil 39, lever 34, under the action of spring 76, moves back from the printing position illustrated in FIG. 4*b* to the non-printing position illustrated in FIG. 4*a*.

Figure 5:
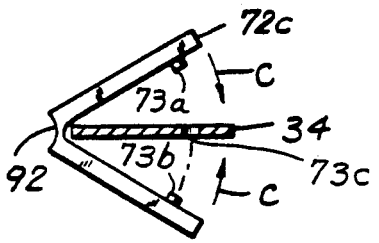
FIG. 5 is an enlarged, sectional view showing another embodiment of the driving lever which may be used in the device of FIGS. 1 and 2.

Referring to FIG. 5, an alternate embodiment for the construction of the ferromagnetic segments for a driving lever 34 is illustrated. A single ferromagnetic segment 72*c*, configured generally in the same shape as ferromagnetic segments 72*a* and 72*b* if placed back to back, is scored along a line 92 so that ferromagnetic segment 72*c* can be folded about lever 34 in the direction of arrows C. Ferromagnetic segment 72*c* has two pins 73*a* and 73*b* extending into a hole 73C to align ferromagnetic segment 72*c* with respect to lever 34. Even though there is electric coupling between the portions of segment 72*c* on opposite sides of lever 34, eddy current losses are still very low because current induced in a portion of magnetic segment 72*c* on one side of lever 34 is in opposition to current induced in the portion of magnetic segment 72*c* on the other side of lever 34. To further reduce eddy current losses, magnetic segment 72*c* may be coated with an insulating material as noted above with respect to magnetic segments 72*a* and 72*b*.

Figure 6:
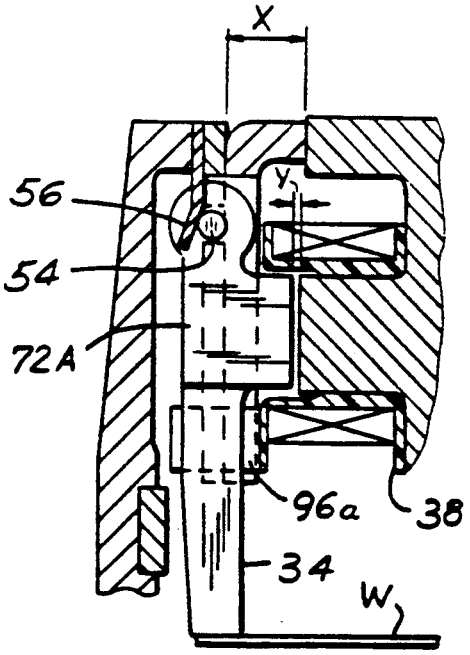
FIG. 6 is an enlarged, partial, cross-sectional view showing the relationship between several of the principal driving components illustrated in FIG. 1 and FIG. 2.

Referring to FIG. 6, the mounting of each lever 34 and its relationship to associated components is illustrated in greater detail. Shaft 54 of each lever 34 is sandwiched between the outer surface of yoke 33 and an inner surface of spring plate 56.

Figure 7:
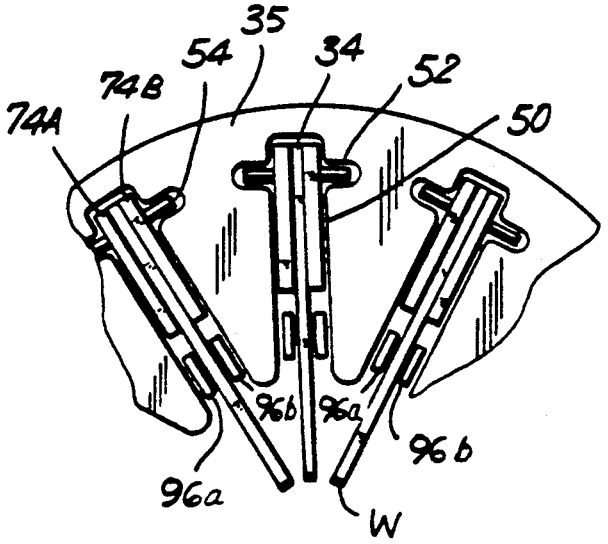
FIG. 7 is a partial sectional view taken along line 7—7 of FIG. 1.

As also illustrated in FIG. 7, a pair of guide plates 96*a* and 96*b* extend from one end of each bobbin 38 to provide guidance as lever 34 pivots about shaft 54, thus, assuring precise alignment of levers 34 and preventing levers 34 from tilting with respect to their preferred axis and binding on yoke 33 or side yoke 35. Guide plates 96*a* and 96*b* also prevent levers 34 from coming into contact with the surfaces defining the slots in yoke 33 and side yoke 35. As also illustrated in FIG. 4*a*, it is preferable that segments 72*a* and 72*b* do not contact the surfaces of slots 48 and 50 which serve as magnetic poles.

Assembly of the components of section 21A is accomplished by aligning the core block 26 so that pin 25 of wire guide 24 will be received in opening 25A in core block 26 when core block 26 is mounted on cylindrical support section 28 of wire guide 24. Then, yoke 33 and side yoke 35 are stacked, respectively, on core block 26. The twelve driving levers 34 are inserted in the radial slots 48 and 50 with their shafts 54 fitted into transverse grooves 52 in side yoke 35. Transverse grooves 52 are thus closed from below by the presence of yoke 33. The twelve driving levers 34 are mounted on side yoke 35 without any positional displacement thereof due to the presence of guide plates 96*a* and 96*b* and transverse grooves 52 which insure accurate positioning. Spring plate 56 is then mounted over the assembly of driving levers 34 in side yoke 35 and cap plate 62 is then mounted over spring plate 56. Shafts 54 of driving levers 34 are therefore trapped and held securely in place within transverse grooves 52, the shafts 54 being sandwiched between the yoke 33 and spring plate 56. This permits driving levers 34 to perform precise and accurate oscillatory motion about respective shafts 54 and assures stable operation thereof.

Figure 8:
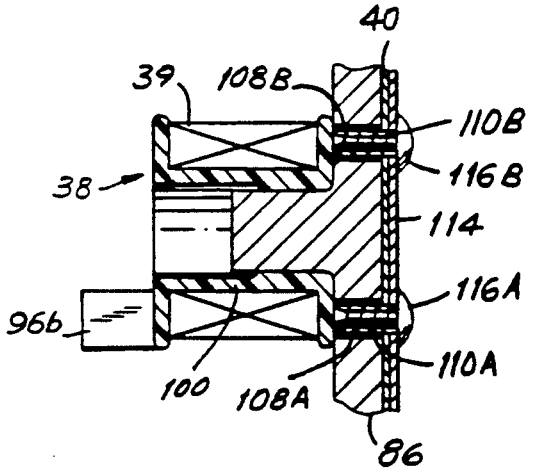
FIG. 8 is an enlarged, cross sectional view showing the coil bobbin of the present invention with the pins thereof assembled to a flexible printed wiring cable connector.
Figure 9:
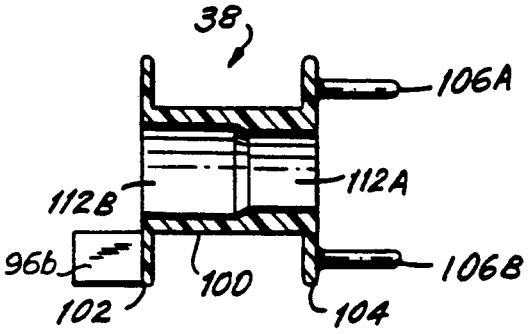
FIG. 9 is an enlarged cross-sectional view of a coil bobbin according to the present invention before assembly.

Referring to FIGS. 8 and 9, according to the present invention, bobbins 38 have a spool portion 100, having flanges 102 and 104. Bobbin 38 is molded from a thermoplastic resin with integral thermoplastic resin pins 106A and 106B. Pins 106A and 106B are dimensioned and spaced from one another so as to pass through corresponding holes 108A and 108B in planar portion 86 of core block 26. Pins 106A and 106B also project through openings in a printed circuit connector 40 mounted to the back surface of planar portion 86 of core block 26. When so positioned, core 36 extends into bobbin 38 so as to occupy substantially the entire volume of small opening 112A and a part of the volume of larger opening 112B which together define an axially extending opening in bobbin 38 (FIG. 9). Opening 112A is of rectangular cross section so as to snugly receive therein core 36, which is also of rectangular cross section. One end 110A of the winding making up coil 39 is wound around pin 106A while the other end 110B of said winding is wound around pin 106B. An insulating material may be applied to the interior surface of holes 108A and 108B to prevent accidental electrical shorting between pins 106A and 106B by core block 26.

Assembly is accomplished by press fitting a bobbin 38 over each of cores 36 so that pins 106A and 106B project from surface 114 of printed circuit connector 40. Ends 110A and 110B of the winding of coil 39 are then soldered to islands on the surface of printed circuit connector 40. During the soldering process, the solder virtually instantaneously provides a connection between winding ends 110A and 110B and their respective islands and solidifies quickly due to the low thermal conductivity and heat capacity of thermoplastic pins 106A and 106B. After soldering, a hot surface such as a soldering iron is brought into contact with the protruding portion of each of pins 106A and 106B. The pins then soften to form bulbous portions 116A and 116B which serve to mechanically secure bobbin 38 by capturing planar portion 86 of core block 26 and printed circuit connector 40 between a surface of bobbin 38 and bulbous portions 109A and 109B. A series of frustoconically shaped recesses 117 (FIG. 1) are provided on the planar surface of wire guide 24, opposed to connector 40 and on the planar surface of end cap 62, opposed to connector 40 for receiving bulbous portions 116A and 116B, associated with each of pins 106A and 106B.

Although it is preferable that bobbin 38 be formed of a thermoplastic material, it may also be formed of one of many heat resistant resins. If pins 106A and 106B are relatively thin, the assembly process discussed above will also be applicable.

Figure 10:
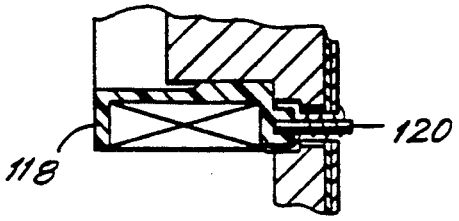
FIG. 10 PRIOR ART
FIG. 10 is an enlarged cross-sectional view of a portion of a conventional coil bobbin in position for assembly.

The use of a bobbin constructed in accordance with the present invention avoids the difficulties cited above with respect to prior art bobbins such as those shown in FIG. 10, wherein a bobbin 118 has metal pins 120. The present invention thus provides a less complex structure which can be assembled with much lower labor costs and with high reliability of the solder connections, while avoiding the problems outlined above with respect to prior art bobbins having metal pins.

Figure 11:
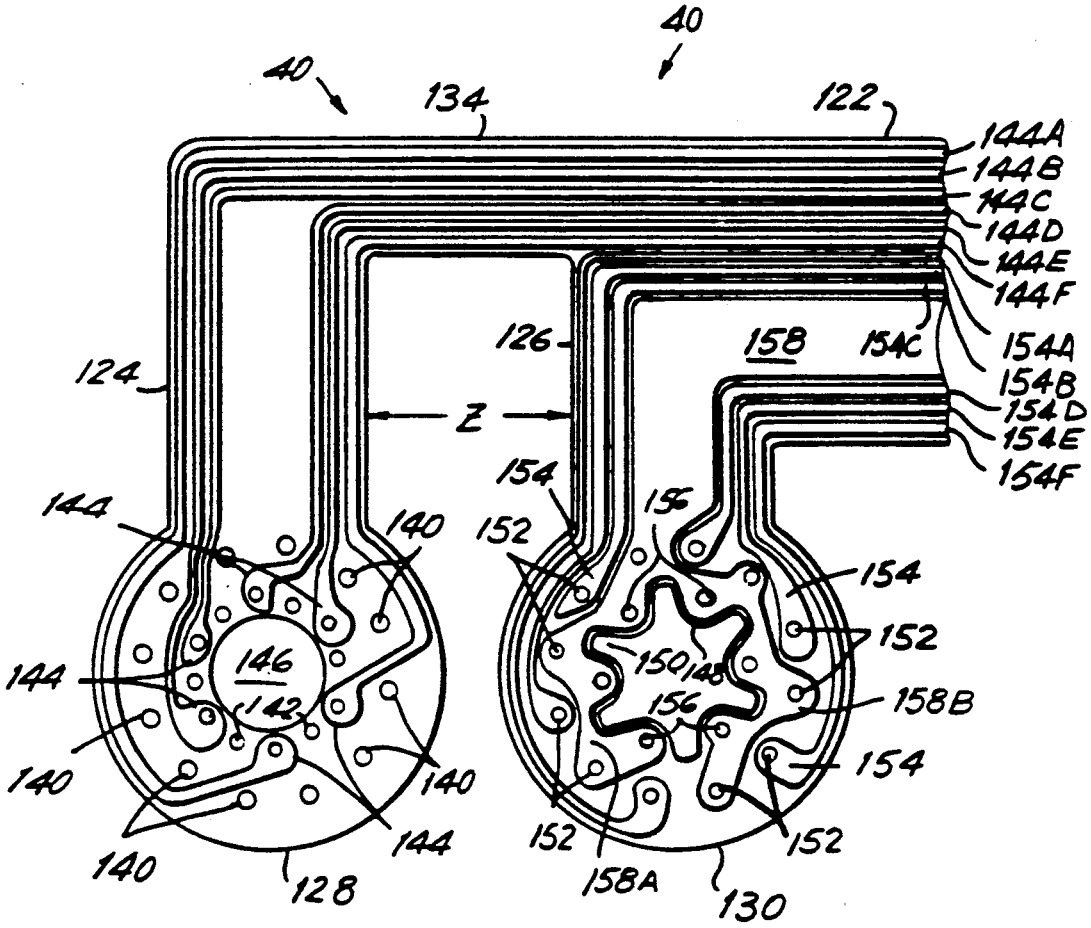
FIG. 11 is a plan view of an embodiment of a flexible printed wiring cable connector according to the present invention.
Figure 12:
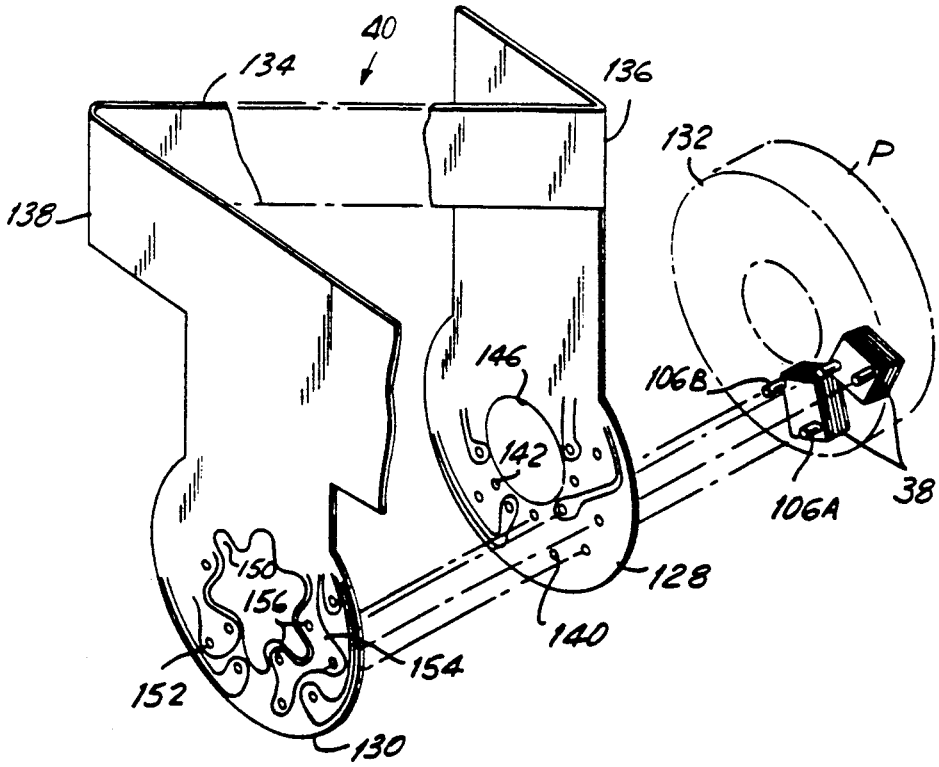
FIG. 12 is a somewhat schematic, perspective view showing the relationship between pin insertion pads, conductive patterns connecting pins from an object, and pin insertion paths of the connector illustrated in FIG. 11, when in use.
Figure 13:
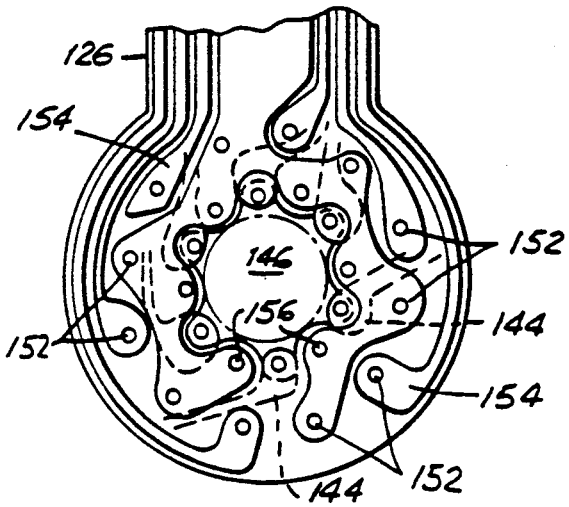
FIG. 13 is plan view showing the connector of FIG. 11 when attached to an object.

FIG. 11, FIG. 12 and FIG. 13 illustrate a flexible printed circuit connector 40. Connector 40 is formed with a flexible substrate 122 having two branches 124 and 126 terminating in circular portions 128 and 130, respectively Circular portions 128 and 130 are shaped so as to be congruent with planar surface 132 of an assembly P FIG. 12) of core block 26 and any associated components, when bobbins 38 have been force fitted on to cores 36 so that their respective pins 106A and 106B protrude perpendicularly from surface 132. Branches 124 and 126 extend from a connecting portion 134 of flexible substrate 122. Connecting portion 134 has a length Z sufficient to allow substrate 122 to be folded along lines 136 and 138 as shown in FIG. 12 so that circular portions 128 and 130 may be stacked upon surface 132 of assembly P.

Circular portion 128 has bored therein twelve through-holes 140 for receiving outer pins 106A of bobbins 38. A second set of through-holes 142 are positioned along a circular path of smaller diameter so as to receive pins 106B of bobbins 38. Alternate through-holes 142 are drilled in the center of conductive islands 144 which terminate conductors 144A, 144B, 144C, 144D, 144E and 144F formed on substrate 122. Circular portion 128 has a central circular opening 146 formed therein.

Circular portion 130 of substrate 122, which is stacked over substrate section 128 after substrate section 128 is stacked on part P, is formed with a central opening 148 having six radially, outwardly extending cut-outs 150. This permits penetration of solder (applied to circular portion 128 to electrically connect six of the pins 106B to islands 144), into the plane of circular portion 130. Circular portion 130 has a series of twelve outer through-holes 152 arranged in a circle so as to receive pins 106A of bobbins 38. Alternate through-holes 152 are surrounded by conductive islands 154 which terminate conductors 154A, 154B, 154C, 154D, 154E and 154F. Thus, solder applied to islands 154 in the vicinity of through-holes 152 provides mechanical and electrical connection to six of the twelve pins 106A. A series of six inner through-holes 156, located on radially inwardly extending projections of circular portion 130 between cut-outs 150, are positioned in a circular path so as to accept alternate pins 106 of bobbins 38. A conductor 158 having branches 158A and 158B has portions which surround through-holes 156 and alternate through-holes 152 which are not surrounded by islands 154. Thus, conductor 158 is electrically connected to one end of the windings of each of bobbins 38. The other ends of the windings of each of bobbins 38 are connected to one of conductors 144A to 144F and 154A to 154F. Thus, connector 40 has formed on substrate 122 thirteen conductors which serve to energize all twelve coils 39 on bobbins 38, with conductor 158 acting as a common conductor for all twelve coils 39.

Assembly of connector 40 to assembly P is accomplished by aligning the through-holes 140 and 142 with appropriate pins 106A and 106B and then inserting said pins in the through-holes so that circular portion 128 is stacked or "piled" on surface 132. The six pins 106B which are surrounded by islands 144 are soldered to islands 144 and mechanically connected as described above with respect to FIG. 8. When soldering of the six pins 106B to be secured to circular portion 128 is completed, connecting portion 134 is folded, as noted above, so that circular portion 130 can be stacked over circular portion 128 with circular portion 130 aligned so that the remaining six pins 106B and twelve pins 106A are received in their respective through-holes 156 and 152. Solder is then applied so as to electrically connect six of the pins 106A to islands 152 and six of the pins 106A and six of pins 106B to portions of branches 158A and 158B of conductor 158.

Thus, during assembly of connector 40 to assembly P, one end of each of the windings of each of bobbins 38 is connected to one of conductors 144A to 144F and 154A to 154F.

This assembly procedure results in a great deal of separation on connector 40 between pins that are soldered. The dispersive soldering pattern therefore permits the use of thicker conductors, thus generating less resistive heating, and promotes reliability by minimizing failure of solder joints due to open connections between a conductor and its respective pin, or shorting between adjacent pins due to spurious solder bridges.

In the assembly procedure outlined above, the upper substrate section is piled on the lower substrate section and soldered to its respective pins after the lower substrate section is soldered to respective pins of the assembly P. It is also possible to first align the upper and lower substrates sections to form a laminated structure, to then insert all of the pins projecting from part P into appropriate holes in the laminated structure, and to then solder all of the pins in one operation to complete electrical connection and mechanical fixation.

In the embodiment described above, connector 40 has two branches. It is also possible, by an extension of the concepts described above, to form a connector having three or more branches to produce a laminated structure having three or more layers.

While in the embodiment described herein cut-outs 150 have been provided along the insertion path for six of pins 106B, relatively large through-holes having dimensions sufficient to allow solder to pass therethrough may also be utilized. Finally, although the pins in the embodiment of the invention described herein are arranged along circular paths, the concepts of the present invention can be equally well applied to pins aligned in straight paths or in any geometric pattern suitable for a given application. Connector 40 is produced by conventional techniques applying the conductive leads to one side of nonconductive substrate 122.

It will be understood, by referring to FIG. 1, that openings 146 of circular portion 128 and opening 148 in circular portion 130 of substrate 122 are large enough so that there is no interference with any part of cylindrical section 28 of wire guide 24 or cylindrical portion 28C of cylindrical centering and support member 28A when core blocks 26 and 26A are assembled thereto.

Figure 14:
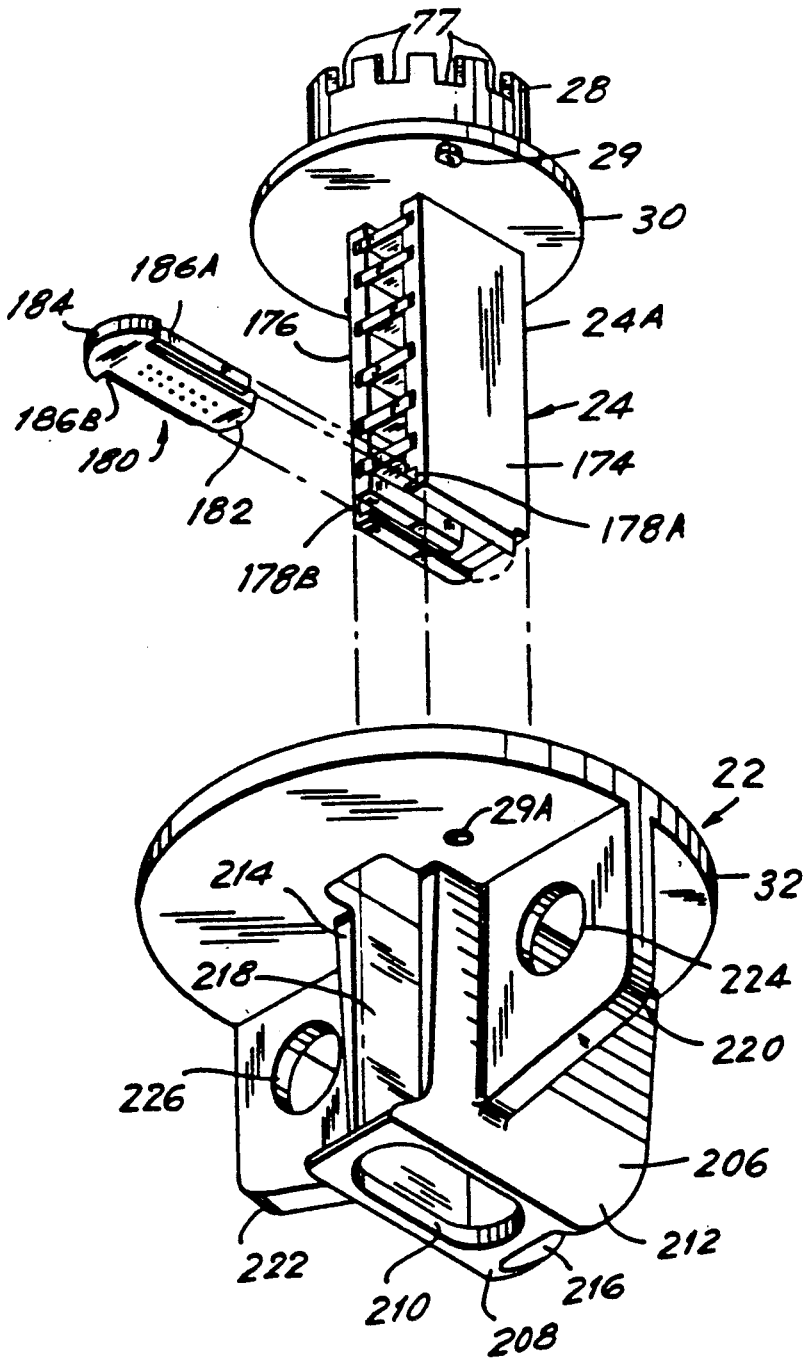
FIG. 14 is an exploded, perspective view showing the principal portions of a wire guide and supporting member of the print wire driving device shown in FIG. 1.
Figure 15A:
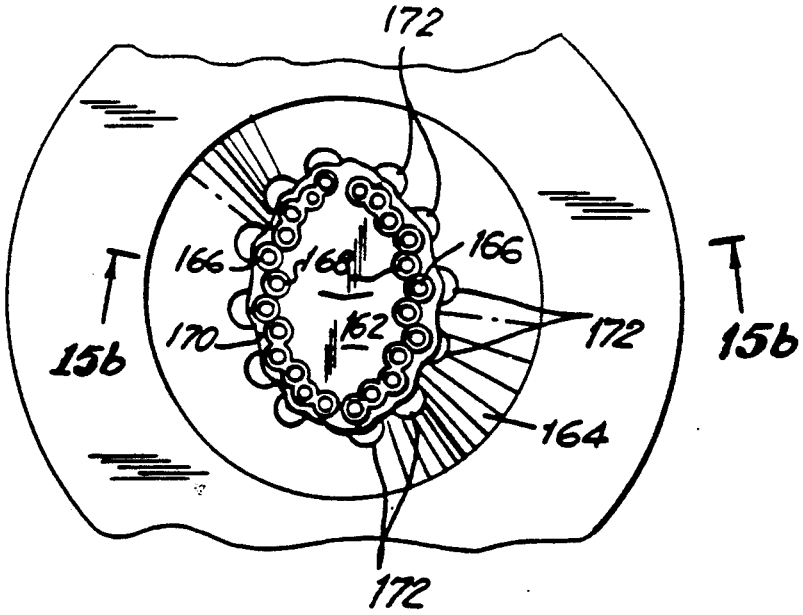
FIG. 15*a* is a plan view of the principal operative portion of the wire guide cylinder of the wire guide illustrated in FIG. 14.
Figure 15B:
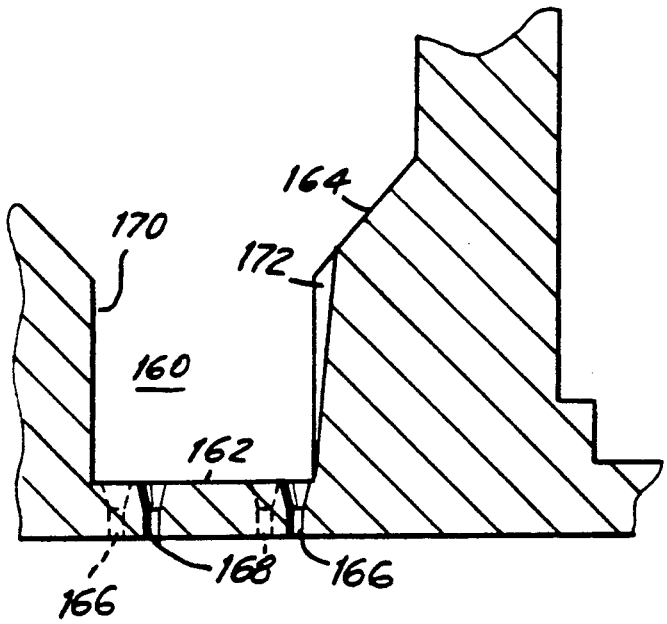
FIG. 15*b* is a sectional view taken along line 15*b*—15*b* of FIG. 15*a;*

Referring to FIG. 14, FIG. 15*a* and FIG. 15*b*, wire guide 24 has a circular flange 30 separating cylindrical support section 28 from a wire nose 24A. The interior of cylindrical support section 28 is shaped to facilitate the insertion therein of print wires W and W' extending from driving levers 34 and 34' respectively. As shown in FIG. 15*a* and FIG. 15*b*, cylindrical support section 28 has formed therein a deep bore 160 defining a bottom 162. Bore 160 has an inclined step portion 164. Bottom 162 has twelve outer through-holes 166 and twelve inner through-holes 168 grouped therein so as to follow a generally oval pattern along two curved lines as shown in FIG. 15*a*. When following the pattern, outer through-holes 166 and inner through-holes 168 are alternately arranged in two inner and outer rows in a zigzag fashion along bottom 162. That is, the centers of outer through-holes 166 fall on a first side of each curved line, while the centers of inner through-holes 168 fall on an opposite side of said line.

Twelve funnel-like guides 172, in the inner wall surface 170 which defines the portion of bore 160 below step portion 164, extend in a direction substantially parallel to the axes of through-holes 166 and 168 at a small angle with respect thereto. Guides 172 are disposed about surface 170 so as to terminate at the intersection of bottom 160 and surface 170 adjacent through-holes 166 and 168. Guides 172, which are of semicircular cross-section with the diameter tapering as bottom 162 is approached, are arranged around surface 170 in two groups corresponding to the positions of outer through-holes 166.

When the assembly of components in section 21A is assembled to wire guide 24, the components are aligned so that alignment pin 25 is received in opening 25A of core block 26 and the print wires W secured to the ends of the driving levers 34 of section 21A are received in corresponding inner through-holes 168. Then, the assembly of components making up section 21B is stacked upon section 21A, pin 25B of cap plate 62 being aligned with hole 25C in core block 26A. This causes the wires W' extending from section 21B to be rotated by an angle corresponding to one-half the angular displacement between successive inner through-holes 168. The ends of the wires W' then slide on inclined step portion 164 and into corresponding guides 172. Guides 172, aligned with outer through-holes 166, guide the ends of the wires W' smoothly into corresponding outer through-holes 166, with the print wires W associated with section 21A providing further guidance.

In an alternative method of assembly, wherein the print wires W and their associated levers 34 are individually placed in section 21A after core block 26 has been assembled to wire guide 24, the inner configuration of cylindrical section 28 still serves as an effective guide for the wires W.

Wire nose 24A, projecting from flange 30, has a U-shaped cross-section wherein the side walls 174 and 176 extend perpendicularly from flange 30 to the front of wire nose 24A. The inner surfaces of side walls 174 and 176 each has a series of six parallel grooves for receiving wire guide plates 80, discussed above.

Side walls 174 and 176 also have two parallel grooves 178A and 178B respectively. Grooves 178A and 178B are in facing relationship near the ends of side walls 174 and 176 so as to receive wire guide member 82 mentioned above with respect to FIG. 1.

Wire guide member 82 is dimensioned so as to project from the end of wire nose 24A along the axis of insertion of wire guide member 82 into grooves 178A and 178B. Member 82 has a front projection 182 which has a curved outer periphery with a shape so that the bottom of wire nose 24A, when member 82 is inserted, has a generally elongated elliptical shape in plan view, i.e. the shape of a rectangle with arcuate short sides. The other end 184 of member 82 has a semicircular shape having a diameter substantially equal to the width of wire nose 24A so that two shoulders 186A and 186B are formed where end 184 joins member 82.

Figure 16:
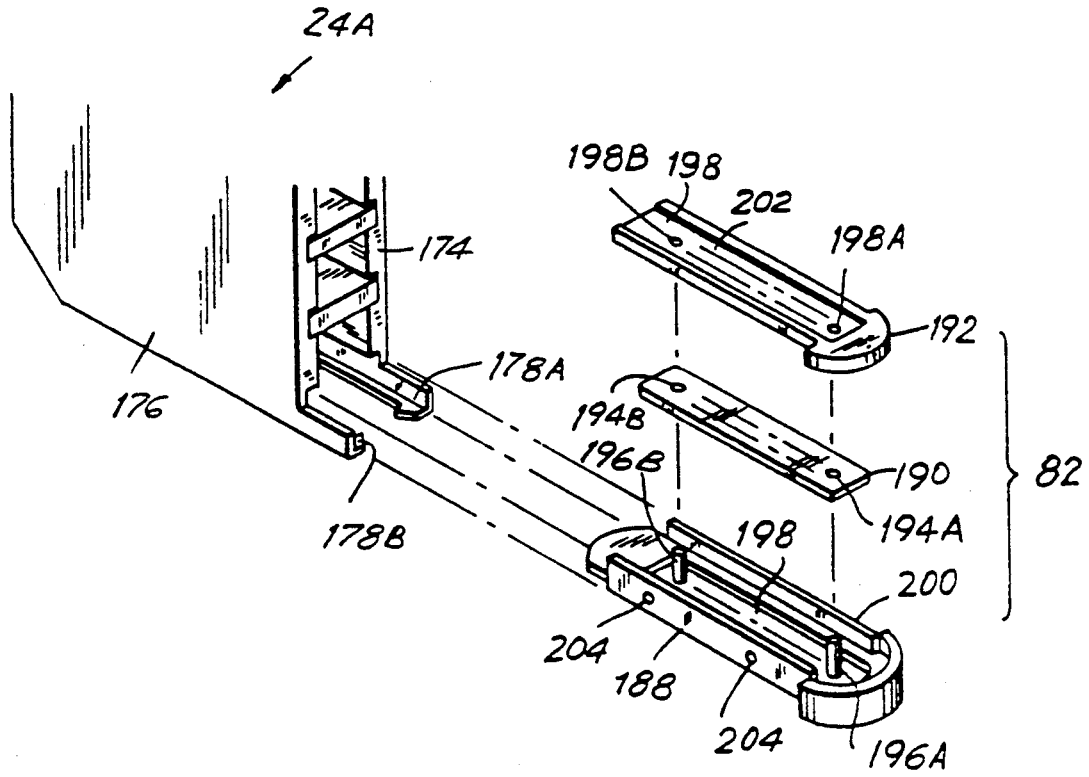
FIG. 16 is an exploded, perspective view of a wire guide member and a portion of a wire nose according to the present invention.

As illustrated in FIG. 16, member 82 has a laminated structure with a front plate 188 made of a polyacetate resin or the like, and a nonmetallic, thin intermediate plate 190, placed on plate 188 and formed of ceramics such as ruby or glass or the like which are not tough materials but have extremely good wear resistance. A cap plate 192 is affixed to plate 188 so as to capture plate 190 between cap plate 192 and front plate 188. Cap plate 192 may be formed from a polyacetate resin.

Intermediate plate 190 is assembled to front plate 188 by aligning holes 194A and 194B with integral pins 196A and 196B extending perpendicularly from front plate 188. A recess 198 is provided in front plate 188 for receiving intermediate plate 190. Cap plate 192 is assembled to front plate 188 by aligning holes 198A and 198B therein with pins 196A and 196B of front plate 188, respectively. A rim 200, extending perpendicularly to the principal planar surface of front plate 188 serves to define a recess wherein cap plate 192 is received. Front plate 188, intermediate plate 190 and cap plate 192, when assembled to form member 82, are configured so that the dimensions of member 82, in length, width and height, permit member 82 to slide into grooves 178A and 178B of walls 174 and 176 of wire nose 24A. Twenty-four wire guide holes 202 in two parallel rows of twelve are bored in front plate 188, intermediate plate 190 and cap plate 192 so that one wire W or W' is guided by each hole 202. Two small projections 204 are provided on each elongate planar external surface of rim 200 to provide an interference fit with the bottom of grooves 178A and 178B so that member 82 is held firmly in place in wire nose 24A.

The laminated construction of member 82, including nonmetallic thin intermediate plate 190 sandwiched between front plate 188 and cap plate 192, minimizes vibrations tending to cause chatter, which would normally appear due to, for example, sight waviness of a print wire with a polished surface moving in a hole in intermediate plate 190. Such vibrations are absorbed as a result of the viscoelasticity of the resin material, thus preventing cracking of the nonmetallic or ceramic intermediate plate 190 by absorbing vibration of intermediate plate 190 which occurs during printing. Thus, smooth sliding of the print wire occurs.

Figure 17:
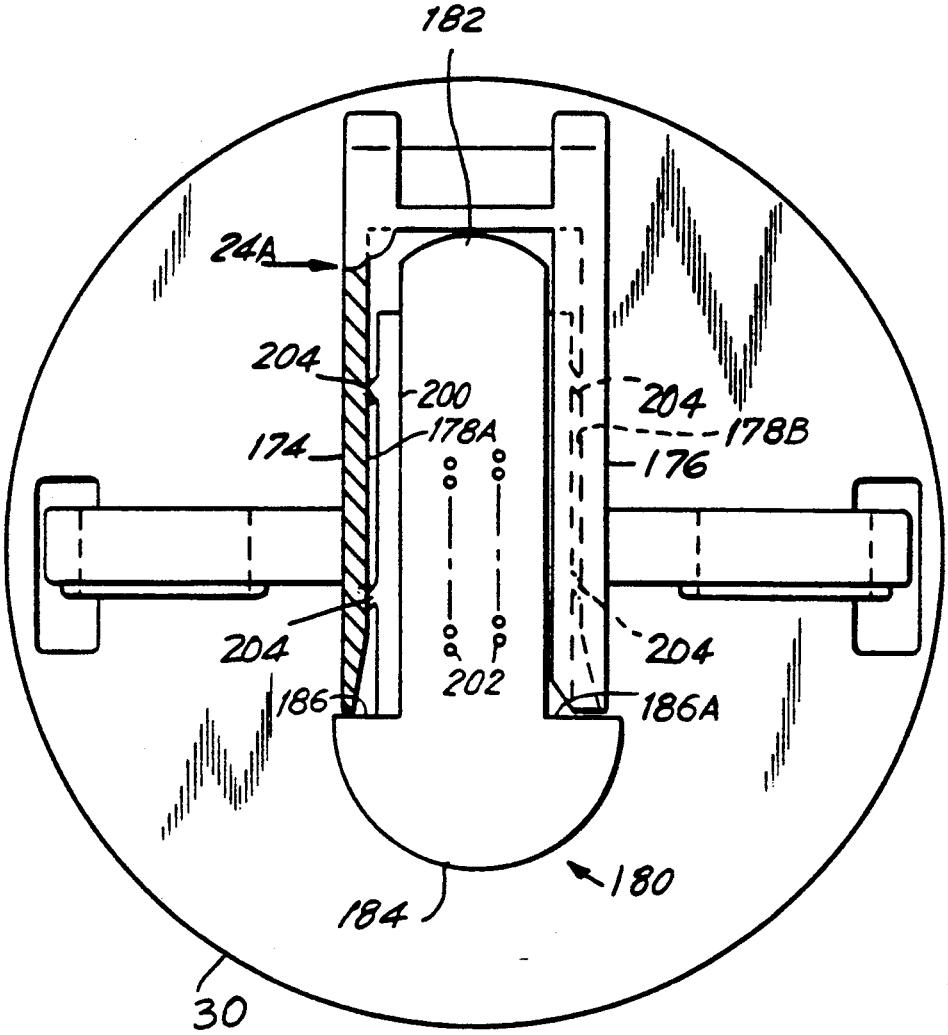
FIG. 17 is a bottom view of the wire guide member mounted for use.

Referring to FIG. 17, when wire guide member 82 is inserted into wire nose 24A, projections 204, which are substantially of conical shape contact the bottom of grooves, 178A and 178B. Projections 204 bend between the bottom of grooves 178A and 178B and rim 200 in a direction opposite to the direction of insertion, thus filling the gap between rim 200 and the bottom of grooves 178A and 178B necessary due to tolerance limitations, and thereby prevent wire guide member 82 from being removed from wire nose 24A due to a wedging action.

Referring again to FIG. 14, support member 22 acts as a metallic cover, having good heat conductivity characteristics, for covering wire nose 24A of wire guide 24. As noted above with respect to FIG. 1, support member 22 includes a flange 32 having a recess therein for receiving flange 30 of wire guide 24. Further, flange 32 has a hole or opening 29A for receiving a pin 29 extending from flange 30 of wire guide 24. Support member 22 is also equipped with a substantially rectangular portion 206 for receiving wire nose 24A of wire guide 24. The bottom 208 of rectangular portion 206 has an opening 210 of substantially elliptical shape identical to the planar shape outlined by the combination of a bottom surface of wire nose 24A and front plate 188 of wire guide member 82. While rectangular portion 206 is defined by a first wall 212, a second wall 214 and bottom 208, a top opening 216 and a bottom opening 218 are provided in rectangular portion 206 thus further facilitating the removal of heat.

Integrally formed between flange 32 and wall 212 is a bracket 220 which is perpendicular to both flange 32 and wall 212. A similar bracket 222 is formed between flange 32 and wall 214 so as to be perpendicular to flange 32 and wall 214. Brackets 220 and 222 are provided with holes 224 and 226 respectively. Brackets 220 and 222 are used to mount apparatus 20 to a carriage (not shown).

To assemble the components described in FIG. 14 to FIG. 17, the wire guide member 82, formed by assembling plates 188, 190 and 192 as described above, is inserted into grooves 178A and 178B of wire nose 24A. Wire guide plates 80 are inserted in a similar manner into the intermediate portion of wire nose 24A between member 82 and flange 30 of wire guide 24. Sections 21A and 21B of print head driving components are then positioned and mounted, starting with the section 21A components being mounted on cylindrical support section 28 as described above.

Metallic support member 22 is then fitted on wire nose 24A of wire guide 24 with hole 29A aligned to receive pin 29 on flange 30 of wire guide 24. Then, plate 66 (FIG. 1) is inserted in recess 64 at one end and recess 68 at the other end so as to secure cap plate 62A in place, thus also securing components of section 21A and section 21B as a unit with support member 22. Wire guide member 82 is thus positioned and secured in place with both ends 182 and 184 of plate 188, projecting along the length of the bottom of wire nose 24A, coming into registration with hole 210 of the bottom surface 208 of support member 22.

The entire apparatus 20 is then mounted to a carriage (not shown) by means of screws (not shown) extending through holes 224 and 226 to secure brackets 220 and 222 to the carriage. Mounting in this manner causes apparatus 20 to be held firmly to the carriage without positional displacement during vibration which occurs when printing, or when the carriage is moved.

Thus it will be seen that according to the present invention, the side yoke is formed with slots so as to pivotally support the magnetic driving levers, while the side yoke and yoke are part of the magnetic path. Further, the yoke is positioned opposite the magnetic cores and the levers are made of laminated magnetic segments. Thus, the driving levers can be driven by magnetic flux passing through the driving members in the direction of their thickness. Further, by making the ends of the driving levers, that is the point where the driving wires are connected, as thin as possible within the bounds of required strength, and arranging the ends of the driving levers in the center section of the head, the print head can be miniaturized to a greater extent and the print wires can be lead to the end of the nose without causing bending. Thus, reduced friction of the print wire on portions of the wire guide permits the ends of the driving levers to be made as small as possible and improves the response characteristics of the print head dramatically.

Further, according to the present invention, since the core block is configured so that its peripheral end surface and the magnetic pole surfaces of the cores are all located in a single plane, the planar surface of the core block and the pole surfaces of all cores can be machined and polished simultaneously and accurately. Further, since the driving levers opposite the magnetic pole surfaces of the cores of the core block are arranged with the thickness of the yoke acting as a spacer, if the peripheral end surface of the core block is used as a reference, the distance between all the print levers and the magnetic pole surface of the cores can be controlled accurately by controlling the thickness of the yoke. Thus, the attraction characteristics of the drive levers can be uniform from wire to wire thereby improving the quality of printing.

Also in accordance with the present invention, the side yoke is formed with radial slots and with grooves perpendicular to said slots for receiving the shafts of the driving levers so that the driving levers are rockable in the slots. The grooves are covered by members attached to the front and back surfaces of the side yoke. By mounting the side yoke on the yoke, positioning and fitting the driving levers in the radial slots and the shafts in the grooves, and then placing a spring plate on the partially assembled structure, the components can be assembled accurately without causing positional displacement of the driving levers. Thus, the assembled driving levers can be caused to achieve accurate oscillatory motion resulting in reliable printing operations.

Further, in accordance with the present invention, since the yoke, having radial slits providing rocking spaces for the levers, is arranged opposing the cores of the core block, which are arranged in a circle, and members projecting from the bobbins surrounding the magnetic cores engage corresponding slots to assist in positioning the yoke and side yoke, it is possible to mount the yoke and side yoke with respect to the axial direction and circumferential direction of the head assembly by using the magnetic pole members and the members projecting from the bobbins as a reference. It is also possible to position the print wire driving levers, which are guided by the radial slots, as well as by the projecting members which engage the radial slots, thus assuring accurate positioning of all of the components of a print wire driving assembly with respect to one another. In addition, another function of the projecting members engaging the radial slots, when these projecting members are used, is to guide the rocking motion of the driving levers, thus, making said motion more reliable.

In accordance with the present invention, since mounting segments or legs made of a synthetic resin are formed integrally with the coil bobbins used in the electromagnets which drive the driving members, these mounting segments or legs may project from the flange portion of the bobbin which may also be made of a synthetic resin. Thus, the bobbin body and mounting legs can be conveniently made in the form of a single unit. Further, since the legs are formed of synthetic resin of low thermal conductively and low heat capacity, the ends of the coil winding coiled about the legs can be soldered quickly and easily to the islands of a printed circuit board pattern by the application of only a small amount of heat. During this process the ends of the legs may be melted by the heat thus forming a bulbous portion which reliably secures the coil bobbin to the circuit board substrate.

Further, in accordance with the present invention since the substrate of a flexible printed wiring cable connector is branched into a plurality of sections which each can be stacked upon one another, and since each section has formed therein pin insertion paths corresponding to the pins of the assembly to be connected to the connector, and each end of the substrate has distributed thereon conductive paths for conducting current to the pins, the configuration of the pattern to be formed on the substrate can be simplified and the width of the conductive paths can be made fairly wide, thus improving the current carrying capacity and reliability of connection.

In addition, according to the present invention, print wire insertion holes are arranged in two circular paths with an inner row and an outer row of holes in a wire insertion passageway being arranged in a tightly packed zigzag pattern. Guide grooves are formed in the side walls of the passageway for the wires. The positioning of the guide grooves corresponds to the outer row of the wire insertion holes. Thus, the print wires corresponding to the inner row of through-holes, and their associated driving assembly are assembled first, permitting insertion of the group of print wires of a second driving assembly automatically and smoothly when these second wires move along the print wires already inserted and along the guide grooves formed in the wall of the wire passageway. Thus the assembly process is remarkably simplified, the thinnest possible wires may be used and the print head assembly can be further miniaturized.

Further, according to the present invention, the member which supports the print head assembly is received in and enclosed by a metallic support member. Further, the print head assembly is mounted to the carriage by means of this metallic support member. Thus, the print head assembly can be positioned and secured accurately to the carriage due to the rigidity of the metal. Further, by using a metal of good thermal conductivity, heat produced in the nose section due to movement of the print wires, and heat generated inside the print head can be readily conducted by the support member so as to escape effectively to the carriage thereby facilitating the removal of heat and further improving long term reliability.

Also in accordance with the present invention, the end of the wire guide and both ends of the wire guide member inserted in the wire guide are together fitted into a hole bored in the bottom surface of the support member. This configuration simultaneously achieves precise positioning of the end of the wire guide with respect to the support member and permits the support member to be attached without the use of fixing members such as machine screws. This further simplifies the assembly process.

Also in accordance with the present invention, the wire guide member is made in the form of a three layer structure by sandwiching a thin plate made of a nonmetallic material such as a ceramic between two synthetic resin plates. The nonmetallic thin plate has extremely good wear resistance and provides durability to the wire guide member. On the other hand, cracking of the nonmetallic thin plate, which is generally not tough, is prevented from occurring due to the viscoelastic damping of the the synthetic resin plates. Thus, smooth contact with the print wires is preserved and a high degree of print quality can be maintained.

Further, in accordance with the present invention, the plate like wire guide member may have on its side surfaces substantially conical projections to lock the member in place when it is inserted into guide grooves in the wire guide. Accurate positioning of the wire guide member is maintained even if a slight gap appears between the bottom of the grooves and the wire guide member because the gap is filled by the projections, which deform, and due to a wedge action, secure the wire guide member rigidly in place, as the projections are bent backward with respect to the direction of insertion, without the need for additional securing members.

It will be thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all the statements of the scope of the invention which, as a matter of language, might be said to fall therebetween.

What is claimed is:

1. A print wire driving apparatus for driving a plurality of print wires in a printer comprising a support member having a wire guide for slidably supporting said print wires, a first wire driving unit having a first end and a second end supported on said support member, a second wire driving unit supported on the second end of said first wire driving unit, said support member and first wire driving unit including first positioning means for positioning said first wire driving unit on said support member, said first and second wire driving units including second positioning means for positioning said second wire driving unit on the second end of said first wire driving unit, and a retaining member having a resilient arm which secures said first and second wire driving units to said support member, said second wire driving unit having a core block facing said second end of said first wire driving unit, said core block having an essentially central opening, said second positioning means including a first portion which extends into said central opening for positioning said second wire driving unit in the radial direction and a second portion for positioning said second wire driving unit in the rotational direction.

2. The print wire driving apparatus as claimed in claim 1, further comprising a plurality of drive levers each coupled respectively to one of said print wires, said plurality of driving levers being angularly spaced one from another by a predetermined angle, said first and second driving units being stacked together with an angular displacement corresponding to one half of said predetermined angle between levers.

* * * * *